US006085538A

United States Patent [19]

Bascaran et al.

[11] Patent Number: 6,085,538

[45] Date of Patent: Jul. 11, 2000

[54] CONTROL BOX DOOR/FAIRING FOR FRONT GRILLE OF AN AIR CONDITIONER

[75] Inventors: Eduardo Bascaran, Santiago; Victoriano Zamora, Santa Catarina; Nestor Hernandez, Mirador Residencial Monterrey; Jose Oliva, San Nicolas de los Garza; David Hernandez, Monterrey, all of Mexico

[73] Assignee: Carrier Corporation, Syracuse, N.Y.

[21] Appl. No.: 09/140,461

[22] Filed: Aug. 26, 1998

[51] Int. Cl.[7] ..... F25D 23/12

[52] U.S. Cl. ..... 62/262; 62/248

[58] Field of Search ..... 62/262, 298; 312/236, 312/328; 454/201

[56] References Cited

U.S. PATENT DOCUMENTS

| | | | |
|---|---|---|---|
| 4,607,500 | 8/1986 | Bolton et al. | 62/262 |
| 5,184,475 | 2/1993 | Matsumi | 62/262 |
| 5,315,842 | 5/1994 | Bolton et al. | 62/262 |

*Primary Examiner*—Henry Bennett
*Assistant Examiner*—Melvin Jones

[57] ABSTRACT

A front grille for the indoor section of an air conditioning unit includes a substantially planar front section, which has air inlet louvers and an air outlet opening formed therein. The front section also includes an opening configured to provide access to the air conditioning unit's control box when the grille is mounted on the indoor unit. The control box access opening is substantially rectangular and is surrounded by three outwardly facing fixed wall sections, each of which is substantially coplanar with the front section. A fourth fixed wall section lies in a plane behind the front section of the grille. An insert is provided, which has a back section and a front wall. The front wall is configured to be coplanar with each of the three fixed wall sections when the back section of the insert is placed in confronting relation with the fourth fixed wall section. Structure is provided for removably attaching the insert to the grille to retain the insert to the back section in the aforementioned confronting relation. The insert may be a narrow insert having a width, which is substantially comparable to that of the three wall sections or, alternatively, may be configured to substantially completely overlie the opening. When the insert is configured to substantially completely overlie the opening, the structure for removably attaching the insert is configured to allow the insert to pivot between a position overlying the opening and a second position where it does not overlie the opening.

4 Claims, 6 Drawing Sheets

CONTROL BOX DOOR/FAIRING FOR FRONT GRILLE OF AN AIR CONDITIONER

BACKGROUND OF THE INVENTION

The present invention is directed to air conditioners and, more particularly, to the configuration of a control box door and/or fairing for the front grille of a room air conditioner.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The indoor grille also includes a region therein wherein the control panel for the air conditioner unit is located.

It is common practice for a basic window room air conditioner unit to have different types of controls associated therewith. More specifically, it is not unusual for the same basic unit to have electromechanical controls, which may include manually actuatable rotary function switches and thermostats, or an electronic control which may include touch sensitive surface switches or infrared-type sensors actuatable by a remote control device. Regardless of the type of controls, it is sometimes desirable to provide a cover for the control components to improve the aesthetic appearance of the air conditioning unit. Alternatively, in electronic control panel design where an infrared remote control must be able to "see" the control panel, a door is not desired.

Because the control panel openings are located in the air conditioners front grille, providing alternative front grille configurations, i.e. with and without a door requires investment in the tooling for making two different grilles. Typically, such grilles may comprise a major one-piece component which is formed from a molded plastic material and the cost of fabricating two different molds would be extremely expensive and not cost effective. Accordingly, it is deemed desirable to have a single grille frame, which can provide both open control box access and a door closing the control box opening while still presenting an aesthetically pleasing grille configuration.

SUMMARY OF THE INVENTION

A front grille for the indoor section of an air conditioning unit includes a substantially planar front section, which has air inlet louvers and an air outlet opening formed therein. The front section also includes an opening configured to provide access to the air conditioning unit's control box when the grille is mounted on the indoor unit. The control box access opening is substantially rectangular and is surrounded by three outwardly facing fixed wall sections, each of which is substantially coplanar with the front section. A fourth fixed wall section lies in a plane behind the front section of the grille. An insert is provided, which has a back section and a front wall. The front wall is configured to be coplanar with each of the three fixed wall sections when the back section of the insert is placed in confronting relation with the fourth fixed wall section. Structure is provided for removably attaching the insert to the grille to retain the insert to the back section in the aforementioned confronting relation. The insert may be a narrow insert having a width, which is substantially comparable to that of the three wall sections or, alternatively, may be configured to substantially completely overlie the opening. When the insert is configured to substantially completely overlie the opening, the structure for removably attaching the insert is configured to allow the insert to pivot between a position overlying the opening and a second position where it does not overlie the opening.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
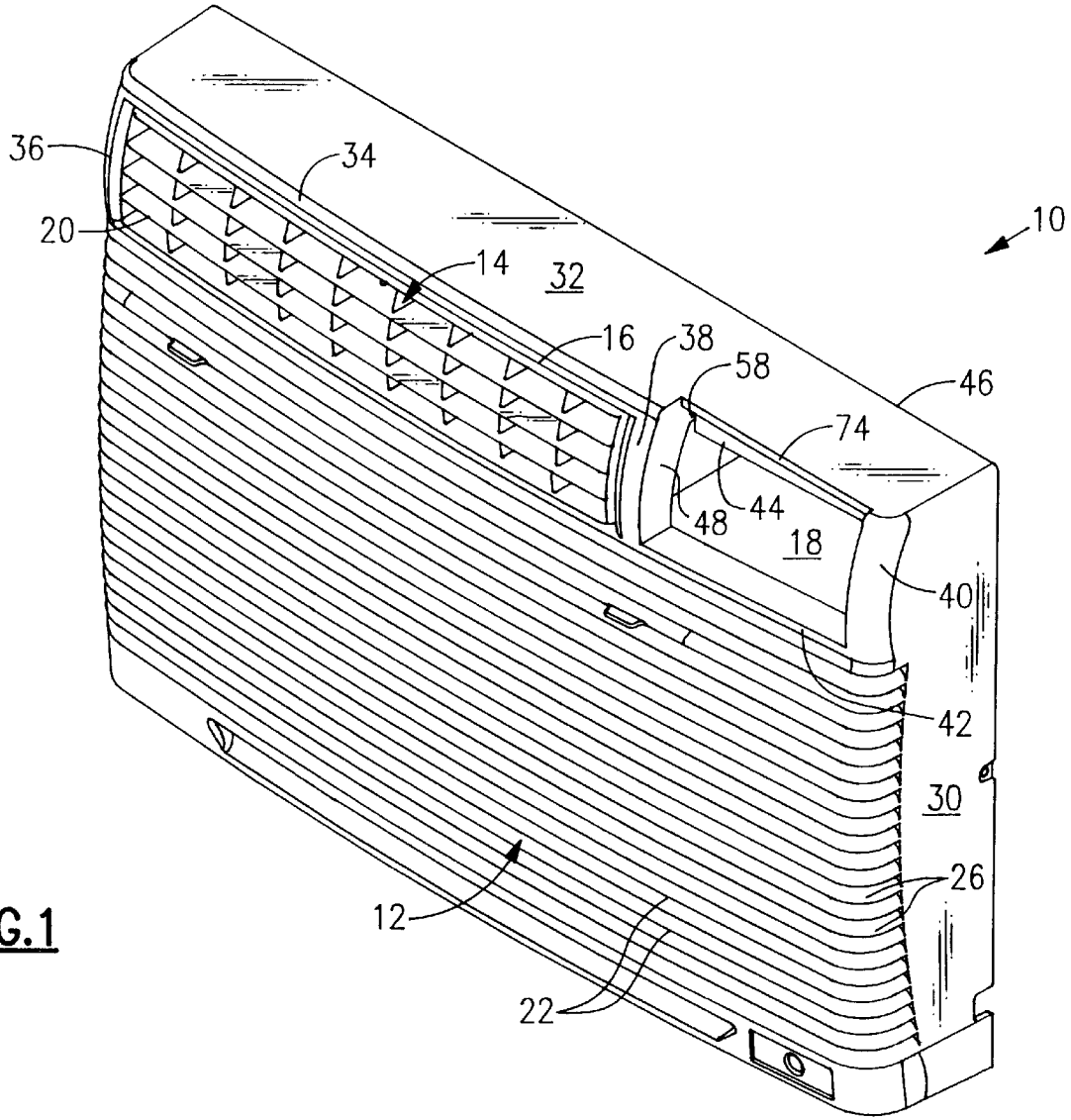
FIG. 1 is a perspective view of a front grille of an air conditioner configured to receive the door and/or fairing of the present invention.

FIG. 1 illustrates a front grille 10 of the type adapted to be mounted to the indoor section of a room air conditioner. The grille includes inlet louvers 12 and air discharge assembly 14 mounted in an air discharge opening 16. Located in the upper right-hand corner of the grille 10 is an opening 18, which is configured to provide access to the air conditioning unit's control box when the grille is mounted on an air conditioner.

With continued reference to FIG. 1, the grille 10 includes a substantially planar front section 20 in which the inlet louvers 12, the air discharge opening/air discharge assembly 14/16 and the control box opening 18 are located. The inlet louvers 12 are defined by a plurality of horizontally extending downwardly facing contoured sections 22, which terminate at the left and right-hand ends 24 and 26, respectively, in curved sections which transition into left and right planar vertically extending side walls 28 and 30, respectively. It will be noted that the louver sections 22 define a gradual outwardly extending arc as they extend laterally across the front of the grille 10.

The grille 10 further includes a horizontally extending planar top wall 32, which interconnects the tops of the left and right side walls 28 and 30. The front edge 34 of the tope wall 32 defines the same curved contour as that of the louver sections 22. The air discharge opening 16 underlies the front edge 34 of the top wall 32 and has left and night narrow wall sections 36 and 38, respectively, which form an outwardly extending arc which is perpendicular to the arc of the louver sections 22.

The control box opening 18 is defined on its left-hand side by the contoured night-hand wall 38 of the air discharge opening 16, which will hereinafter be referred to as the "left-hand wall 38". The right-hand side of the opening 18 is defined by a wall section 40, which has the same outward contour as the left-hand wall 38 and, further, has a left-to-right contour, which matches the contour of the right-hand ends 26 of the louver sections 22. The bottom of the control box opening 18 is defined by a horizontally extending substantially planar wall section 42, which intersects with the left wall 38 and the right wall 40, and lies in substantially the same plane as these wall sections.

The top of the control box opening 18 is defined by a horizontally extending substantially planar wall 44, which lies below the plane defined by the side and bottom walls, as described above. The recessed top wall 44 also does not follow the curved contour of the front edge 34 of the top wall 32, but rather is parallel to the horizontally extending rear edge 46 of the top wall 32.

Figure 9:
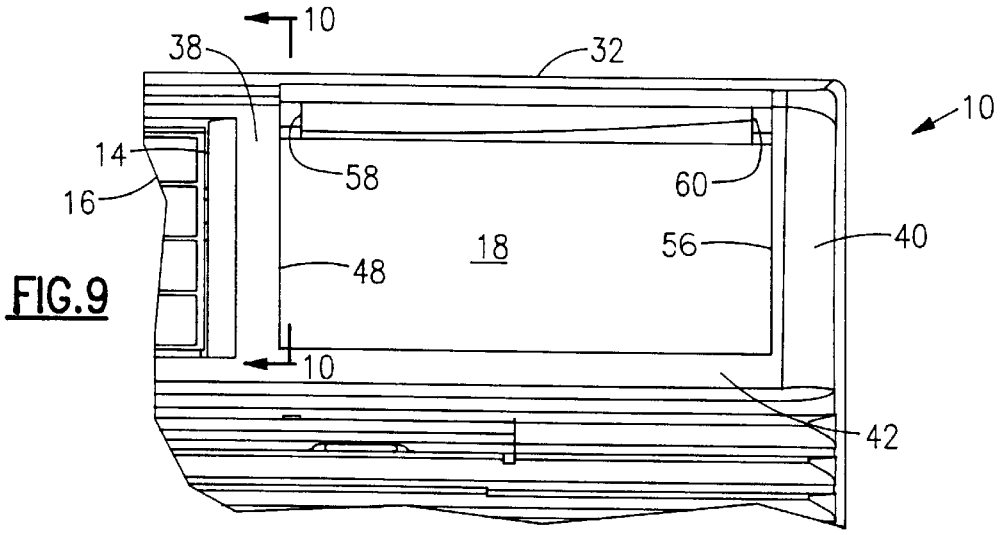
FIG. 9 is an enlarged view of the upper right-hand corner of the grille illustrated in FIG. 3.
Figure 10A:
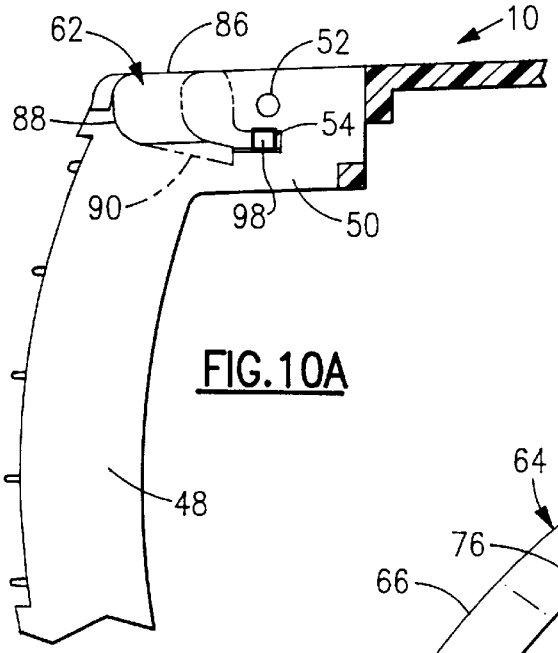
FIG. 10A is a sectional view taken along the line 10—10 of FIG. 9, with the fairing insert shown in phantom lines.

Extending rearwardly and perpendicularly to the left wall 38 of the control box opening is a planar side wall 48. The planar side wall 48 is shown in detail in FIGS. 10A and 10B as including an upper rearward extension 50, which includes a circular opening 52 and a rectangular opening 54 therein. The right-hand side wall 40 has a similar planar perpendicularly rearwardly extending side wall 56, extending therefrom which is in parallel spaced relationship with the planar side wall 48 described above. The side wall 56 is not shown in detail in the drawing figures, however, it is provided with a rearward extension having a circular opening and a rectangular opening identical to and in axial spaced relationship with the circular opening 52 the rectangular opening 54 in the extension 50 of the left-hand side wall 48. As best seen in FIGS. 1 and 9, the recessed top wall 44 has a rectangular notch provided therein at both the left and right-hand sides thereof 58 and 60, respectively. These notches provide access to the circular and rectangular openings on the side walls 48 and 56.

As so configured, the control box opening 18, and the surrounding structure described above may be fitted with a simple contoured fairing component 62 or with a door component 64. The door 64 is configured to cover the opening 18 under normal circumstances and to be manually pivotally opened to obtain access to the air conditioner's control panel, as necessary.

Figure 8:
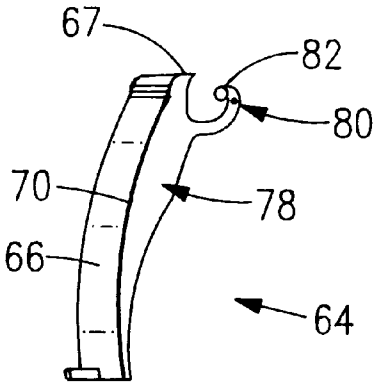
FIG. 8 is a right-hand side view of the door of FIG. 7.
Figure 5:
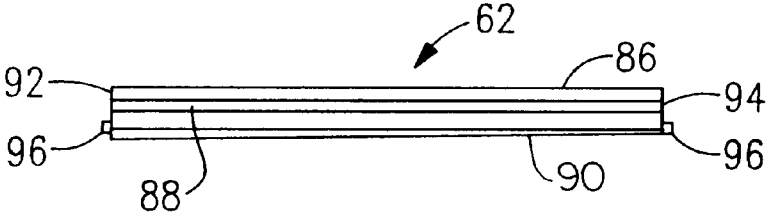
FIG. 5 is a front plan view of the fairing insert.
Figure 7:
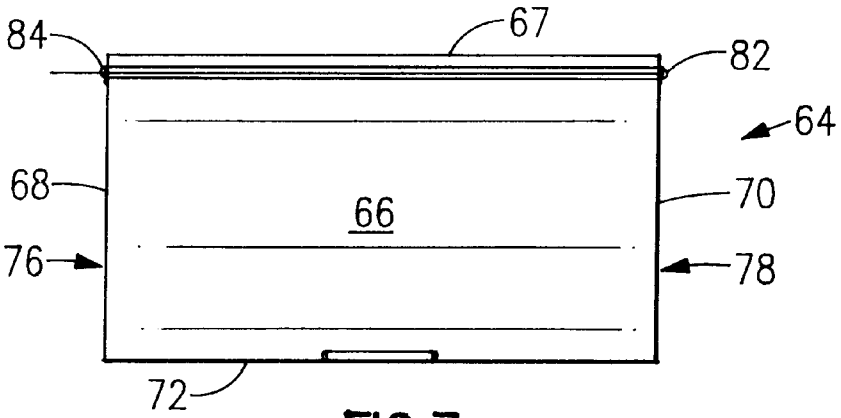
FIG. 7 is a front plan view of the door insert of the present invention.

Looking first at the door 64, FIGS. 2, 11, 12 and 10B illustrate the door installed to the front grille 10, while FIGS. 7 and 8 illustrate the door 64 in detail.

Figure 2:
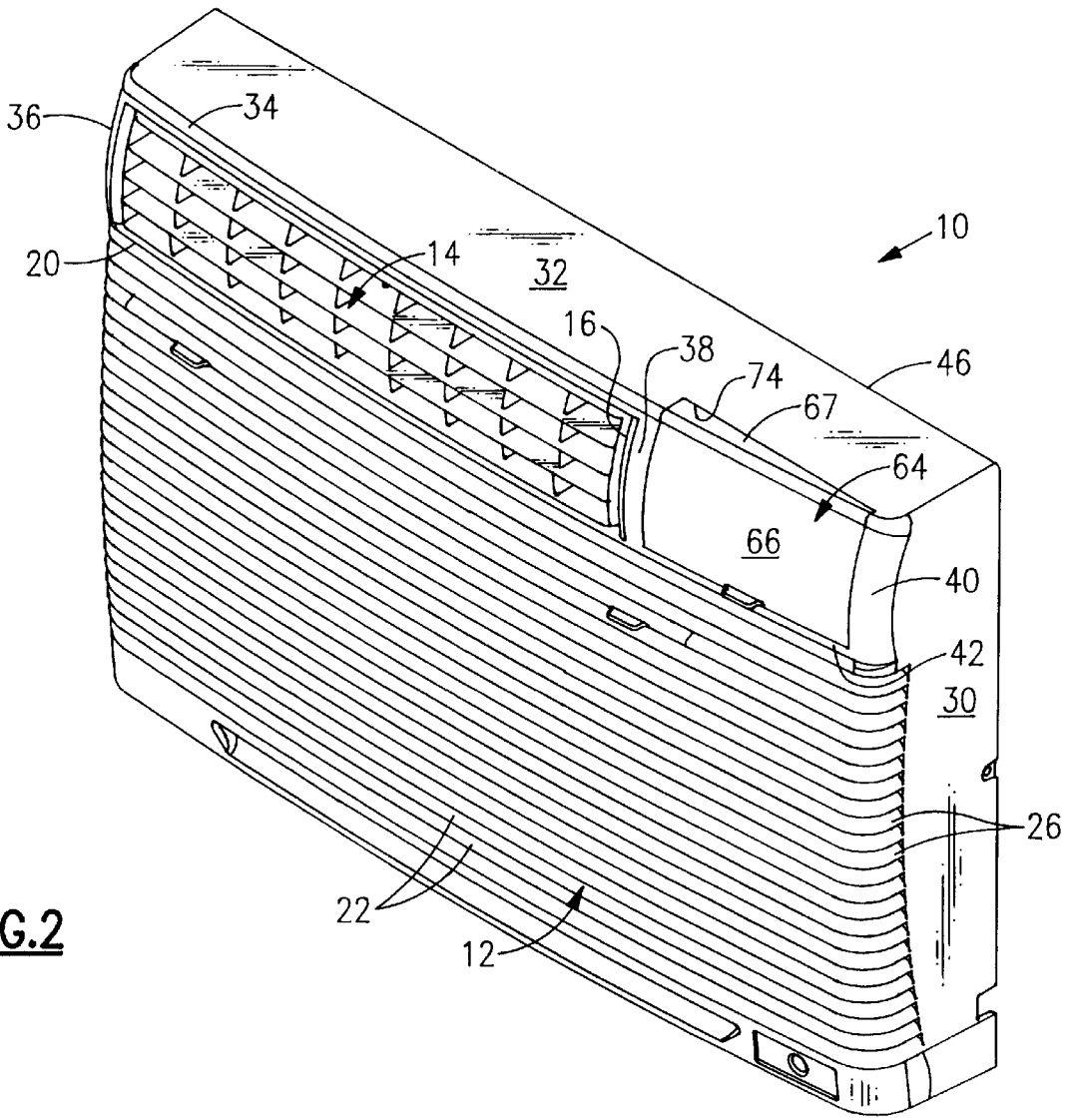
FIG. 2 is a view similar to FIG. 1 with a control box door installed thereon.
Figure 4:
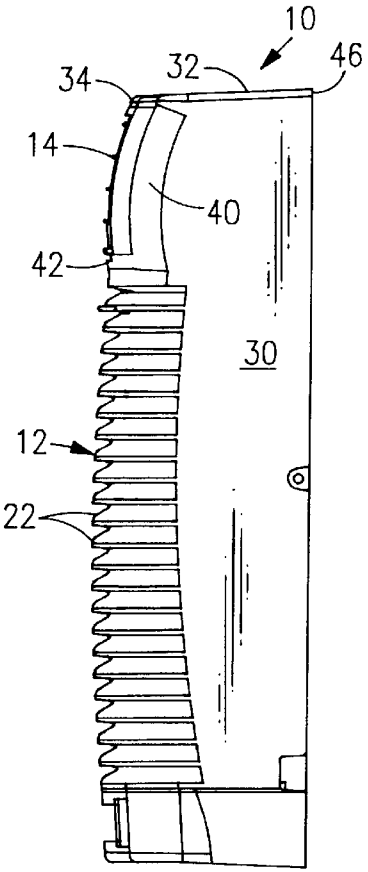
FIG. 4 is a right-hand side view of the grille of FIG. 3.
Figure 3:
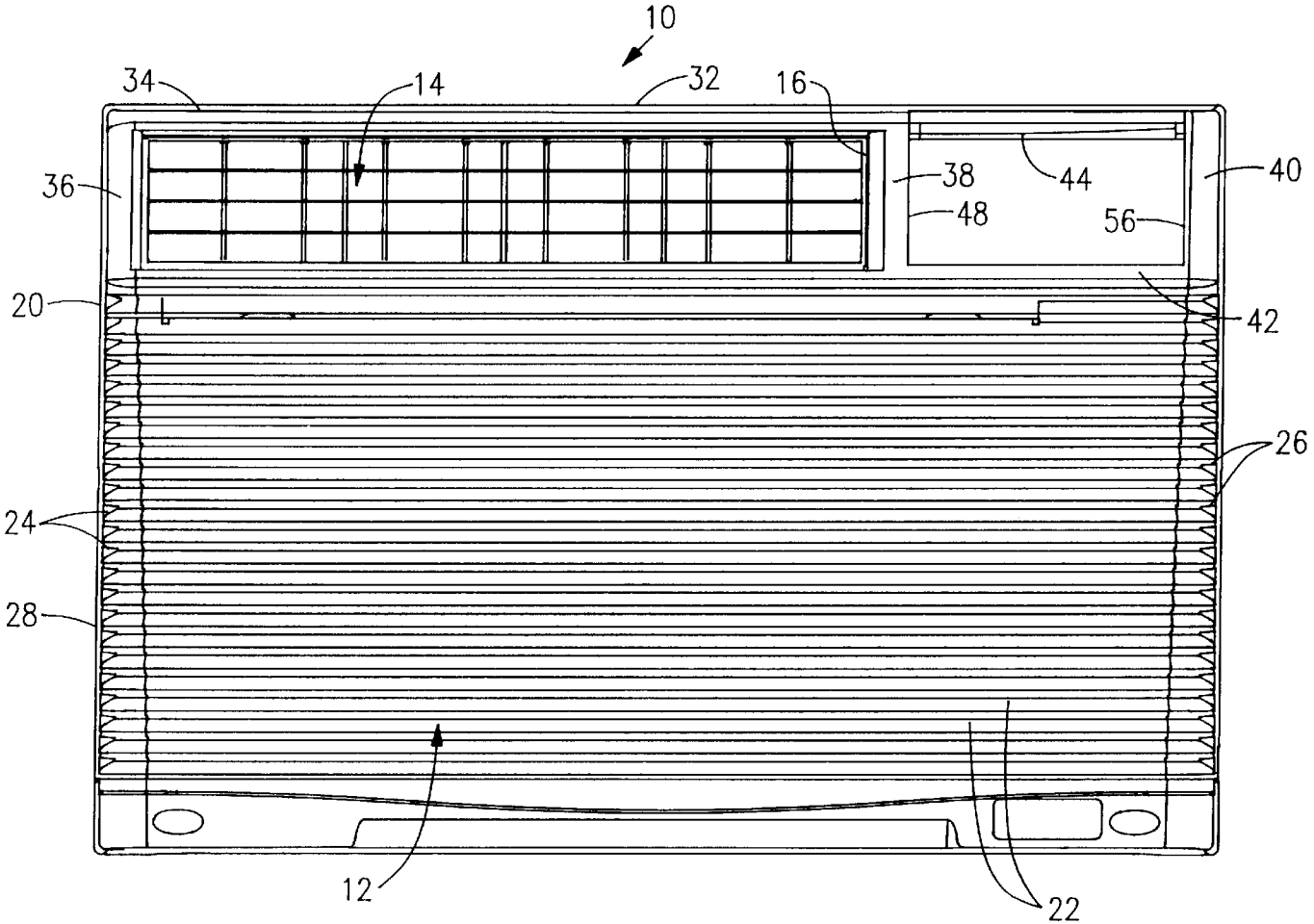
FIG. 3 is a front plan view of the grille, as illustrated in FIG. 1.
Figure 6:
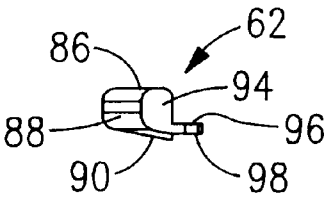
FIG. 6 is a right-hand side view of the insert of FIG. 5.

The door 64 comprises a front wall 66 and a top wall 67, which are contoured such that they cooperate with one another to close the control box opening 18 and to blend in with the surrounding structure of the grille 10. Specifically, the left edge 68 and the right edge 70 of the front wall 66 have the same contour as the left wall 38 and the right wall 40, respectively, of the control box opening 18. Likewise, the bottom edge 72 of the front wall 66 follows the same contour as the bottom wall 42 of the opening 18. As best seen in FIGS. 1 and 2, the wall 44 defining the top of the control box opening 18 and the contoured front edge 34 of the top 32 of the grille cooperate to define a tapered opening 74 in the top 32 of the grille. The top wall 67 of the door 64 is configured to fill the tapered opening 74 when the door is installed to the grille.

Extending rearwardly from the left and right edges 68 and 70 of the front wall 66 are left and right side walls 76 and 78, respectively. The right side wall 78 is illustrated in detail in FIGS. 8 and 10B where it is seen to have a curved hinge 80 formed integrally therewith, which extends rearwardly and upwardly and which terminates with an outwardly extending pivot pin 82 at the end thereof. The left-hand side wall 76 lies behind the right side wall, as viewed in FIGS. 8 and 10B and also carries a hinge identical to the hinge 80 of the right side wall and has a pivot pin 84 extending to the left, as viewed in FIG. 7, which is in axial alignment with the pivot pin 82 of the right side wall hinge 80.

Figure 10B:
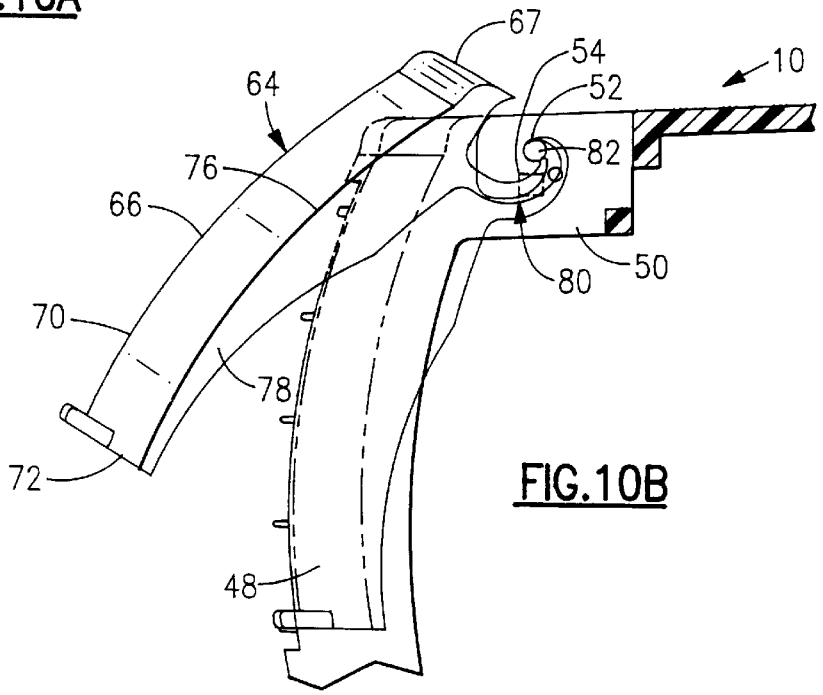
FIG. 10B is a sectional view taken along the line 10—10 of FIG. 9, with the door insert illustrated.
Figure 11:
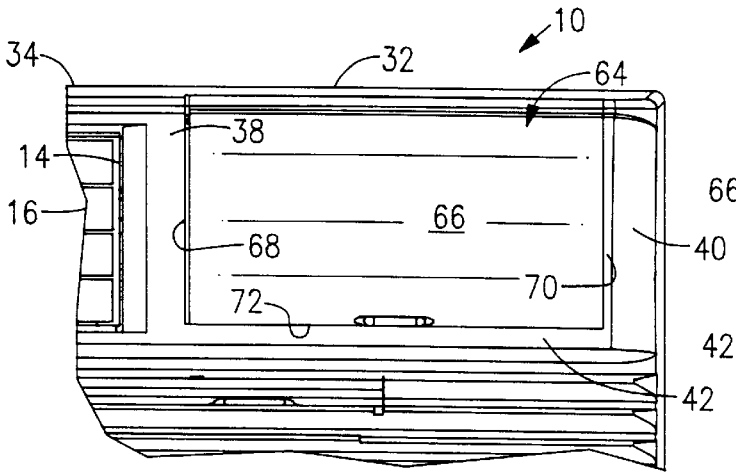
FIG. 11 is a view similar to FIG. 9 with the door insert in place.
Figure 12:
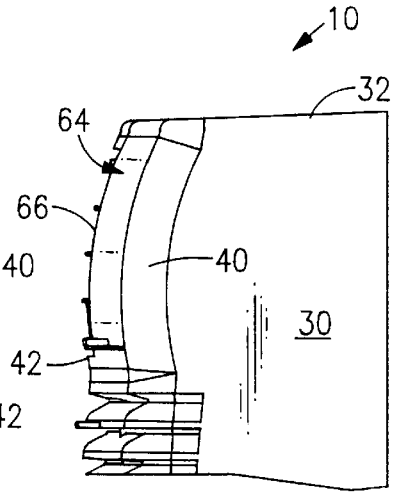
FIG. 12 is a right side view of the portion of the grille illustrated in FIG. 11.
Figure 13:
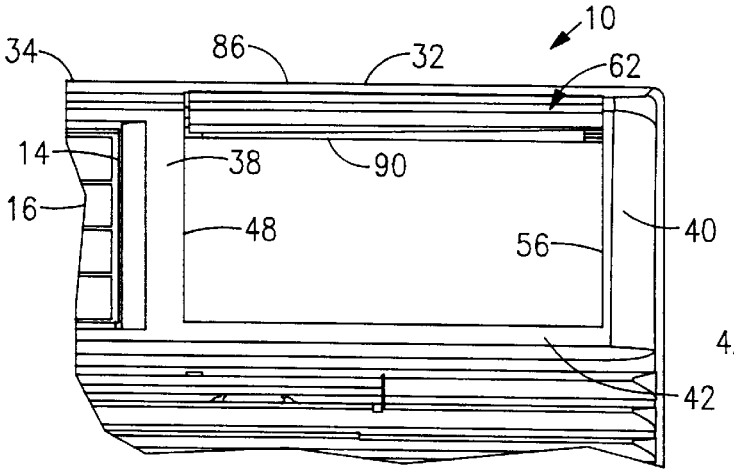
FIG. 13 is a view similar to FIG. 9 with the fairing insert in place.
Figure 14:
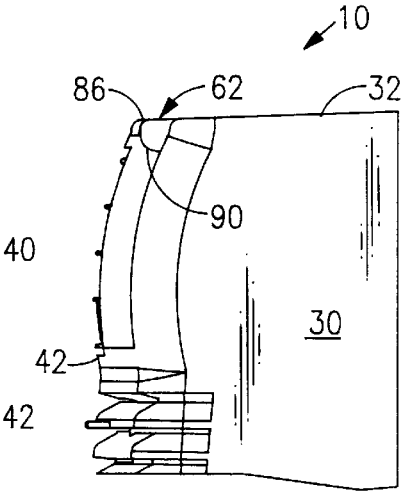
FIG. 14 is a right side view of the grille portion illustrated in FIG. 13.

The door 64 is installed to the grille 10 by inserting the hinge elements 80 into the left and right notches 58 and 60 formed in the top wall 44. During installation, the pins 82 and 84 will contact the left and right side walls 48 and 56, respectively, and the hinges will flex inwardly until the pins move into engagement with the circular openings 52 in the side walls. The circular openings and the pins are sized such that the door is affixed in the position illustrated in FIGS. 2, 11 and 12, and is pivotable about the axis defined by the openings 52 and the pivot pins 82 and 84 received therein. Partial movement of the door 64 upwardly about the axis is illustrated in FIG. 10B. It should be appreciated that the configuration of the hinges 80 with respect to the door and the surrounding structure of the control box opening is such that the door may be opened to a substantially horizontal position to obtain full access to the control panel. When the door is released, the door will return to its closed position under the influence of gravity.

FIGS. 9, 10A, 13, and 14 illustrate the grille with the fairing component 62 installed. The fairing 62 includes a top wall 86, which is configured to fill the tapered opening 74 in the top 32 when the fairing insert is installed to the grille. A front wall 88 of the insert extends downwardly from the top wall 86 and is contoured to blend into the curved front edge 34 of the grille and the top of the right-hand wall 40 of the control box opening 18. The bottom wall 90 of the fairing is configured to define a horizontally extending surface, which is perpendicular to the left and right planar side walls 48 and 56 to thereby define a continuous rectangular perimeter defining the control box opening 18. The left and right end walls 92 and 94 are provided with rearwardly extending flexible latches 96, each of which is further provided with a latching head 98 at the end thereof. The latching heads 98 are configured to be received in the rectangular openings 54 in the side walls 48 and 56 to retain the fairing insert 62 in its installed position. As with the pivot pins 82 and 84, the latches 96 are configured to flex inwardly to facilitate installation and flex outwardly to hold the latch heads 98 in positive engagement with the rectangular openings 54.

What is claimed is:

1. A front grille for an indoor section of an air conditioning unit of the type including a substantially planar front section, which has air inlet louvers formed therein, an air outlet opening therein, and an opening configured to provide access to the units control box when the grille is mounted on the indoor section, wherein the improvement comprises:

said control box access opening being substantially rectangular and being surrounded by three outwardly facing fixed wall sections, each substantially coplanar with said front section, and a fourth fixed wall section lying in a plane behind said front section of said grille;

an insert having a back section and a front wall, said front wall being configured to be coplanar with each of said three fixed wall sections when said back section of said insert is placed in confronting relation with said fourth fixed wall section; and means for removably attaching said insert to said grille to retain said insert with said back section in said confronting relation.

2. The apparatus of claim 1 wherein said control box access opening is adjacent a comer of said grille and said three outwardly facing fixed wall sections have a substantially ornamental contour thereon; and wherein said front wall of said insert has a complementary contour thereon.

3. The apparatus of claim 2 wherein said control box access opening has a predetermined width and a predetermined length, and each of said three outwardly facing fixed wall sections has a width which is substantially less than either said predetermined width or predetermined length; and wherein said front wall of said insert has a width which is substantially comparable to that of said three sections.

4. The apparatus of claim 2 wherein said control box access opening has a predetermined width and a predetermined length, said front wall of said insert is configured to substantially completely overlie said opening; and wherein said means for removably attaching said insert to said grille is configured to allow said insert to pivot between a first position wherein it overlies said opening and a second position where it does not cover said opening at all.

* * * * *